US005791976A

United States Patent [19]

Honda

[11] Patent Number: 5,791,976

[45] Date of Patent: Aug. 11, 1998

[54] SURFACE MACHINING METHOD AND APPARATUS

[75] Inventor: Katsuo Honda, Mitaka, Japan

[73] Assignee: Tokyo Seimitsu Co., Ltd., Tokyo, Japan

[21] Appl. No.: 753,915

[22] Filed: Dec. 3, 1996

[30] Foreign Application Priority Data

Dec. 8, 1995 [JP] Japan ..... 7-320580

[51] Int. Cl.[6] ..... B24B 5/01

[52] U.S. Cl. ..... 451/288; 451/41; 451/60; 451/63; 451/271; 451/291; 451/38

[58] Field of Search ..... 451/288, 400, 451/41, 60, 63, 385, 271, 291, 292

[56] References Cited

U.S. PATENT DOCUMENTS

| | | | |
|---|---|---|---|
| 4,211,041 | 7/1980 | Sakulevich et al. | 451/291 |
| 4,615,145 | 10/1986 | Matsumoto et al. | 451/400 |
| 4,726,150 | 2/1988 | Nishio et al. | 451/271 |
| 4,916,868 | 4/1990 | Wittstock | 451/271 |
| 4,979,334 | 12/1990 | Takahashi | 451/271 |
| 5,516,328 | 5/1996 | Kawada | 451/271 |

FOREIGN PATENT DOCUMENTS

| | | |
|---|---|---|
| 6-270041 | 9/1994 | Japan . |
| 6-344250 | 12/1994 | Japan . |

*Primary Examiner*—Robert A. Rose
*Assistant Examiner*—George Nguyen
*Attorney, Agent, or Firm*—Sixbey, Friedman, Leedom & Ferguson; David S. Safran

[57] ABSTRACT

A wafer is rotated on its axis, which is biased with regard to an axis of a grinding wheel, and revolves around an axis which is biased with regard to the axis of the wafer and the axis of the grinding wheel. In this state, the grinding wheel is abutted against the surface of the wafer. Thus, all abrasive grains on the grinding wheel can act on the whole surface of the wafer.

9 Claims, 12 Drawing Sheets

ω1=60rpm, ω3=330rpm
R=75mm

ω1=60rpm, ω3=330rpm
R=100mm

ω1=60rpm, ω3=330rpm
R=125mm

SURFACE MACHINING METHOD AND APPARATUS

BACKGROUND OF THE INVENTION

1. Field of the Invention

The present invention relates to a surface machining method and apparatus. More particularly, the present invention relates to a surface machining method and apparatus for brittle materials such as semiconductor materials, ceramics, glass, or the like.

2. Description of the Related Art

Loose abrasive for lapping, polishing, etc. is mainly used in mirror grinding for brittle materials such as semiconductor materials and ceramics. The loose abrasive is suitable for obtaining a flat and smooth surface; however, it is not suitable for the grinding which requires large throughput and high shaping accuracy. Since many wafers are ground at the same time in order to obtain the large throughput, the apparatus must be large-sized. Moreover, since the diameter of the wafer has been increased, there is a disadvantage in the accuracy of the lapping plate when the wafer of a large diameter is machined. Furthermore, the wafer cannot be efficiently machined by the loose abrasive.

In order to eliminate the above-mentioned disadvantages, a loose abrasive processing apparatus (e.g. a lapping apparatus and a polishing apparatus) which performs a single wafer processing is desired. Moreover, the transfer from the loose abrasive processing to the bonded abrasive processing has been desired.

In the conventional bonded abrasive processing, the center of the workpiece is machined only by the abrasive grains on the radius of the grinding wheel, which goes through the rotational center of the workpiece. For this reason, there are disadvantages in that the width of the grinding wheel is small, and if the machining speed is raised, the grinding resistance acting on each abrasive grain becomes larger. Furthermore, there are disadvantages in that the accuracy greatly depends on the state of the grinding wheel (the form and the dressing state); thus, the bonded abrasive processing is not suitable for the mirror grinding.

Furthermore, since the abrasive grains move on the same track, the movement of abrasive grains cannot be greatly changed even if the conditions such as the number of rotations, etc. are changed. The abrasive grains are concentrated on the rotational center of the workpiece, and the abrasive grains in the other area do not go through the rotational center of the workpiece. Thereby, there is a disadvantage in that warps are scattered on the surface.

SUMMARY OF THE INVENTION

The present invention has been developed in view of the above-described circumstances, and has as its object the provision of a surface machining method and apparatus in which all abrasive grains on the grinding wheel can act on the whole surface of the workpiece.

In order to achieve the above-mentioned object, the present invention provides a surface machining method in which a workpiece is pressed against a rotating disk so as to machine a surface of the workpiece, comprising the step of rotating the workpiece on a rotational center biased from a rotational center of the disk, and revolving one of the workpiece and the disk around a revolution center biased from the rotational center of the workpiece and the rotational center of the disk, thereby machining the surface of the workpiece by the two rotations and one revolution.

According to the present invention, one of the rotating workpiece and the rotating disk is revolved so that the surface of the workpiece can be machined by the two rotations and one revolution.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
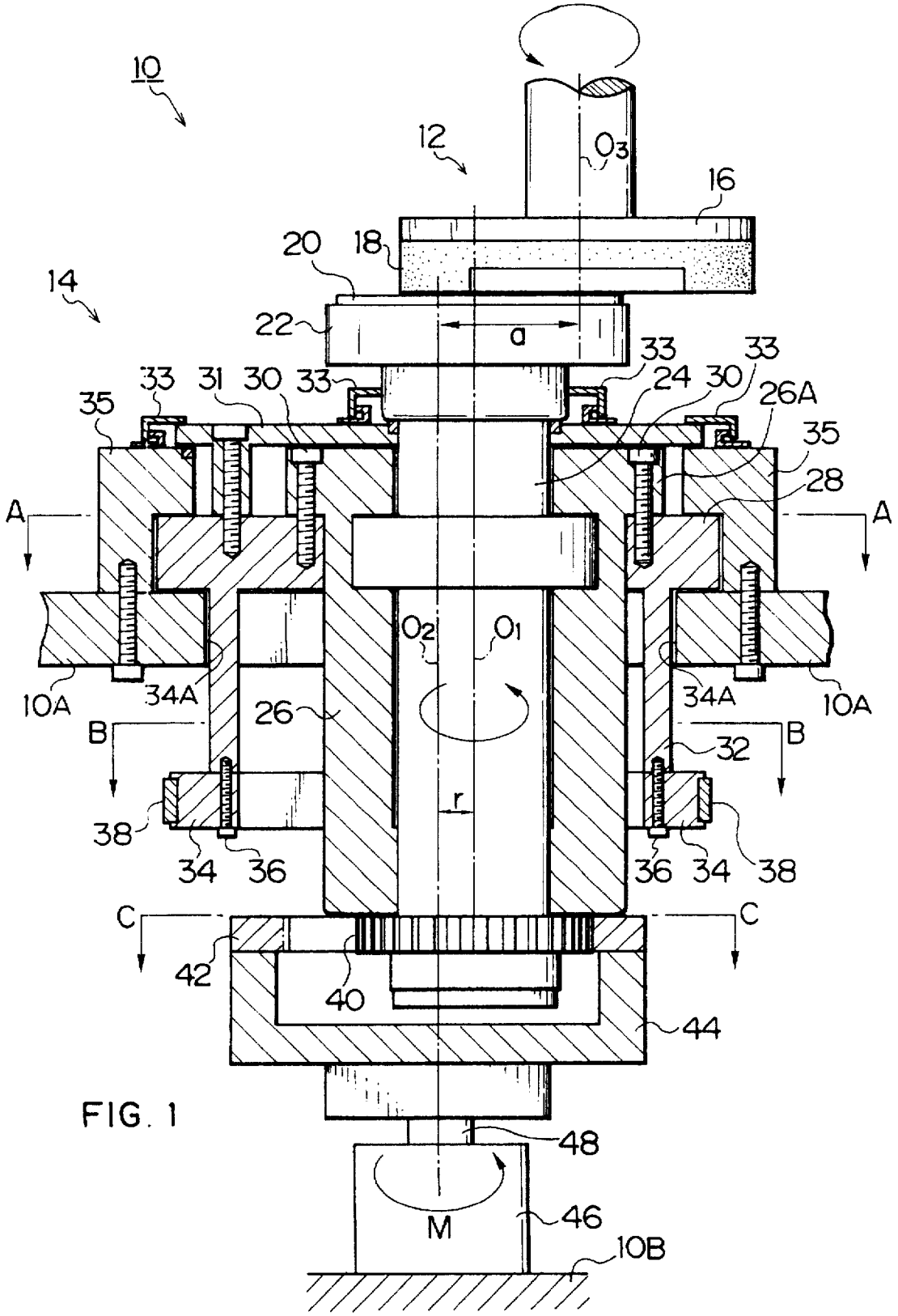
FIG. 1 a sectional side view illustrating the structure of a surface machining apparatus according to the present invention.

FIG. 1 is a sectional side view illustrating an embodiment of a surface machining apparatus according to the present invention. As indicated, the surface machining apparatus 10 is comprised mainly of a grinding wheel rotating section 12 for rotating a grinding wheel 18, and a wafer rotating section 14 for rotating a wafer 20.

The grinding wheel rotating section 12 is arranged above the wafer rotating section 14, and the grinding wheel rotating section 12 has a grinding wheel table 16 which is driven by a motor (not shown) to rotate. The grinding wheel table 16 is disk-shaped, and it is provided in a lifting device (not shown). When the lifting device is driven, the grinding wheel table 16 moves in upward and downward directions in the drawing.

The grinding wheel 18 is cup-shaped, and it is fixed on an axis $O_3$ coaxially with the grinding wheel table 16. A toroidal diamond grinding wheel is used as the grinding wheel 18, and the toroidal bottom end surface is abutted against the wafer 20 so that the surface of the wafer 20 can be ground.

With this arrangement, when the motor (not shown) is driven, the grinding wheel 18 rotates around the axis $O_3$, and when the lifting device is driven, the grinding wheel 18 moves in upward and downward directions in the drawing.

On the other hand, the wafer rotating section 14 is provided below the grinding wheel rotating section 12, and the wafer rotating section 14 has a wafer table 22 supporting the wafer 20 as a workpiece. The wafer table 22 is disk-shaped, and the wafer 20 is secured to the top of the wafer table 22 in vacuum so that the wafer 20 can be fixed there.

A spindle 24 connects to the bottom of the wafer table 22 on an axis $O_1$, coaxially with the wafer table 22. The spindle 24 is rotatably supported by an inner periphery of a cylindrical bearing 26.

Figure 2:
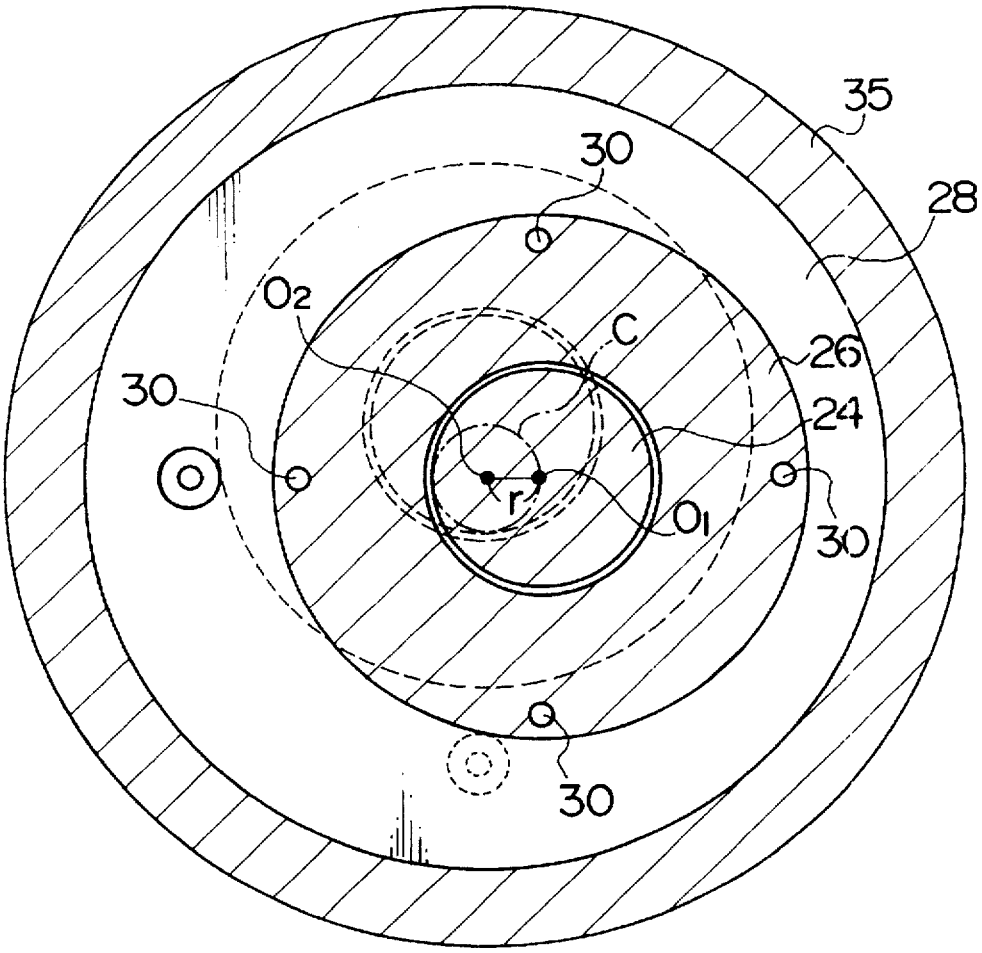
FIG. 2 is a sectional view taken along line A—A of FIG. 1.

The bearing 26 is bolted to a rotary table 28 by bolts 30, 30, . . . , via a flange 26A which is formed at the top end of the bearing 26. As indicated in FIG. 2 (a sectional view taken along line A—A of FIG. 1), the axis $O_2$ of the bearing 26 is not coaxial with the axis $O_1$ of the rotary table 28. The axis $O_2$ is biased by r from the axis $O_1$ of the rotary table 28.

The rotary table 28 is disk-shaped, and as shown in FIG. 1, a cylindrical leg section 32 is formed coaxially with the rotary table 28 at the bottom of the rotary table 28. The leg section 32 is engaged with a hole 34A which has a diameter substantially equal to a diameter of the leg section 32. The hole 34A is formed at a body frame 10A of the surface machining apparatus 10. On the other hand, the rotary table 28 is anchored by an annular-shaped member 35 which prevents the rotary table 28 from coming off. The member 35 is arranged at the top of the body frame 10A. The vertical and horizontal movements of the rotary table 28 are regulated. Thus, the rotary table 28 can rotate only with regard to the body frame 10A. Reference numeral 31 is a cover member for preventing chips, etc. from getting into the body of the apparatus, and the cover member 31 is provided at the rotary table 28 and rotates with the rotary table 28. Reference numeral 33 is a seal member for preventing chips, etc. from getting into the body of the apparatus in the same way as the cover member 31.

Figure 3:
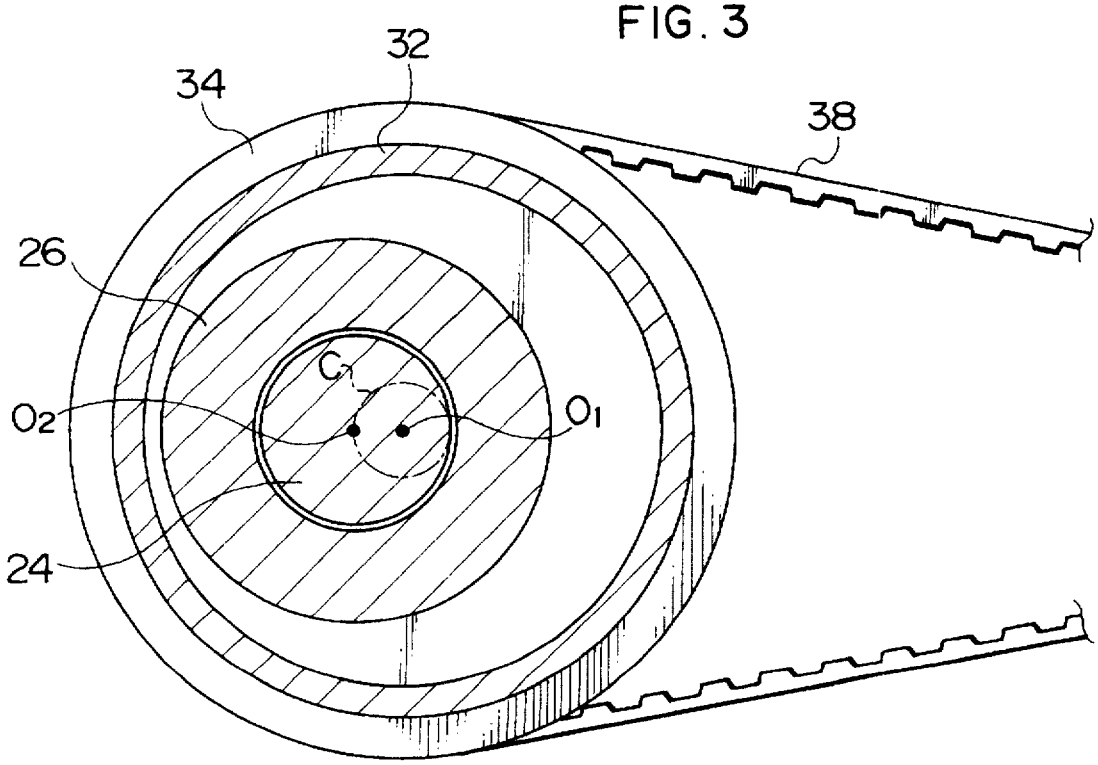
FIG. 3 is a sectional view taken along line B—B of FIG. 1.

A gear 34 is fixed to the bottom end of the rotary table 28 coaxially with the leg section 32 by bolts 36, 36, . . . A timing belt 38, which connects to a rotation-drive source (not shown), is wound on the gear 34 (see FIG. 3). Thus, when the rotation-drive source is rotated, the rotation is transmitted via the timing belt 38 so that the rotary table 28 can rotate.

The bearing 26 is fixed to the rotary table 28, and if the rotary table 28 rotates, the bearing 26 rotates in connection with the rotary table 28.

As shown in FIG. 2, however, the axis $O_1$ of the bearing 26 is not coincident with the axis $O_2$ of the rotary table 28. Thus, the bearing 26 does not rotate coaxially with the rotary table 28, but it rotates on a circle C about the axis $O_2$ of the rotary table 28. That is, the bearing 26 revolves on the circle C with a revolution radius (r). A center of the circle C is the axis $O_2$ of the rotary table 28.

The spindle 24 (the axis $O_1$), which is supported by the bearing 26, revolves on the circle C in which its center is the axis $O_2$ of the rotary table 28 and which has the revolution radius (r).

The spindle 24 does not only revolve but also rotates on its own axis. As shown in FIG. 1, a gear 40 is provided at the bottom of the spindle 24 coaxially with the spindle 24. The gear 40 is engaged with an internal gear 42, and the internal gear 42 connects to a rotary axis 48 of a motor 46, which is placed on the body frame 10A of the surface machining apparatus 10, via a cup-shaped connecting member 44.

Figure 4:
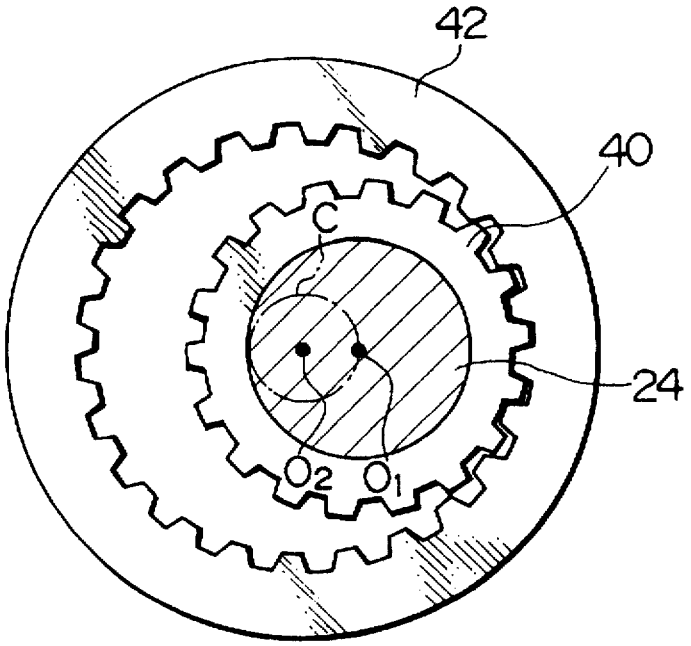
FIG. 4 is a sectional view taken along line C—C of FIG. 1.

An axis of the internal gear 42 is provided on the axis $O_2$ coaxially with the rotary table 28. As indicated in FIG. 4 (a sectional view taken along line C—C of FIG. 1), the center $O_1$ of the gear 40 moves on the circle C concentric with the internal gear 42. Thereby, the gear 40 is kept engaged with the internal gear 42.

If the motor 46 is driven, the rotation of the motor 46 is transmitted via the internal gear 42 and the gear 40 so that the spindle 24 can rotate.

With this arrangement, if the motor 46 is driven, the wafer 20 rotates on its own axis, and if a rotating section (not shown) is driven, the wafer 20 revolves.

Next, an explanation will be given about the operation of an embodiment of the surface machining apparatus according to the present invention, which is constructed in the above-mentioned manner.

First, the center of the wafer 20 is matched with that of the wafer table 22, and then the wafer 20 is secured to the wafer table 22 in vacuum and fixed thereon.

Next, the grinding wheel table 16 is rotated about the axis $O_3$ to rotate the grinding wheel 18. At the same time, the wafer table 22 is rotated to thereby rotate the wafer 20 on the axis $O_1$, and the rotary table 28 is rotated to thereby revolve the wafer 20 around the axis $O_2$.

Next, the grinding wheel table 16 is moved down while the grinding wheel 18 is rotating and the wafer 20 is rotating and revolving. Then, the bottom of the grinding wheel 18 is abutted against the surface of the wafer 20. Thereby, the surface of the wafer 20 is ground by the grinding wheel 18.

An explanation will hereunder be given about how abrasive grains form a polished surface of the wafer 20 and how much abrasive grains are involved in the grinding process.

Figure 5:
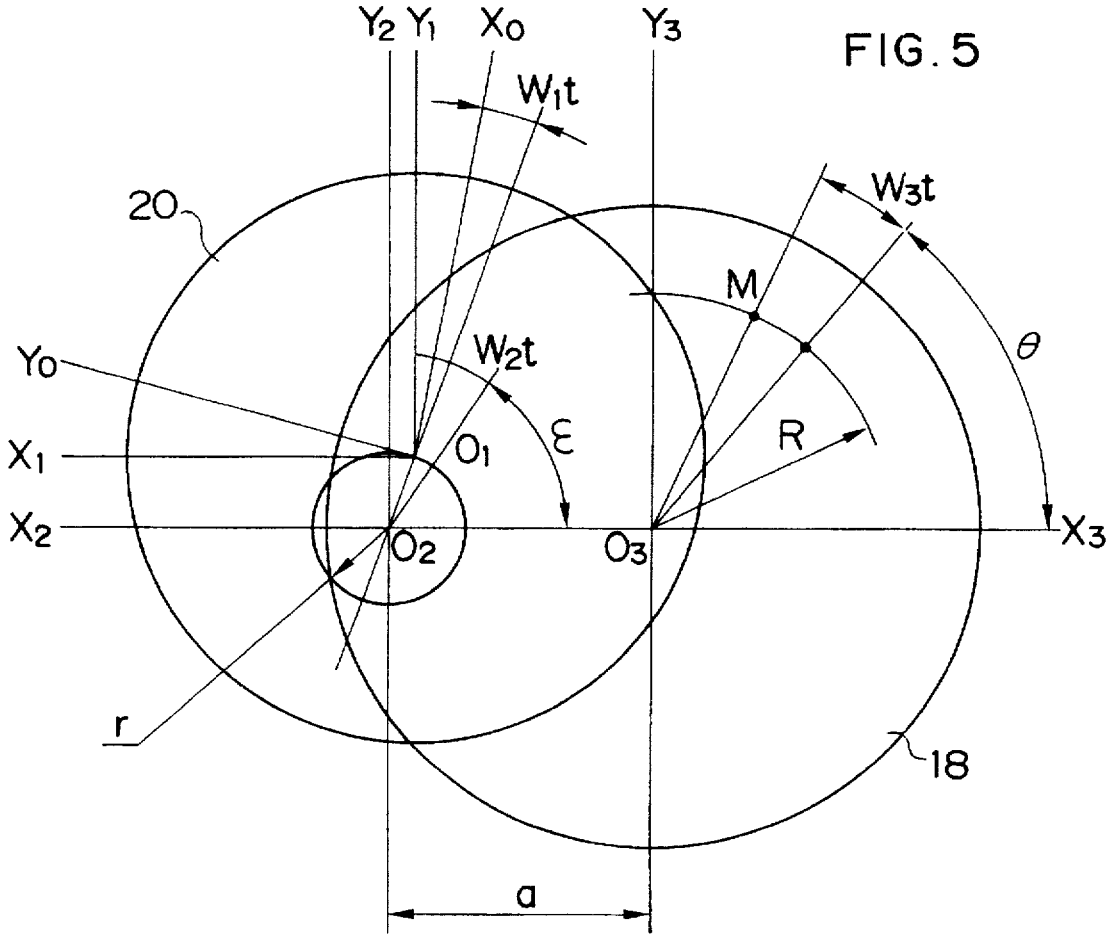
FIG. 5 is an analytic model of grinding tracks of abrasive grains.
Figure 6:
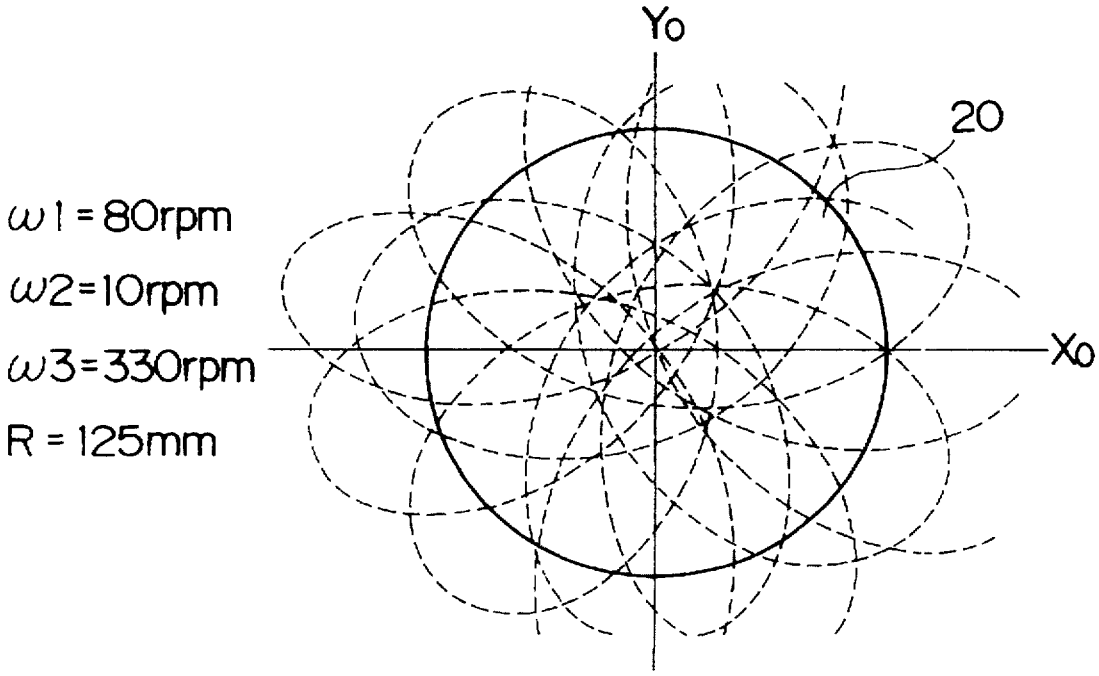
FIG. 6 shows the grinding track of an abrasive grain during machining in a surface machining method according to the present invention.

As shown in FIG. 5, an angular velocity of abrasive grain M in a coordinate system $O_3$–$X_3Y_3$ fixed to the grinding wheel 18 is referred to as $\omega_3$. A position of the revolution center $O_2$ of the wafer 20 is referred to as (−a, 0). An angular velocity of the rotational center $O_1$ of the wafer 20 in the coordinate system $O_2$–$X_2Y_2$ fixed on the revolution center $O_2$ of the wafer 20 is referred to as $\omega_2$. An angular velocity of the coordinate system $O_1$–$X_0Y_0$ of the wafer 20 at the rotational center $O_1$ is referred to as $\omega_1$. In polar coordinates, a position of arbitrary abrasive grain M at a time t=0 is referred to as (r, θ), and a position of the rotational center $O_1$ of the wafer 20 is referred to as (r, ε). Equations of movement in the grinding tracks in the coordinate system $O_1$–$X_0Y_0$ of the wafer 20 is as follows:

$$X=R\cdot\cos\{\theta-\epsilon-(\omega_1+\omega_2-\omega_3)\cdot t\}-r\cdot\cos(\omega_1\cdot t)+a\cdot\cos\{\epsilon+(\omega_1+\omega_2)\cdot t\}\quad(1)$$

$$Y=R\cdot\sin\{\theta-\epsilon-(\omega_1+\omega_2-\omega_3)\cdot t\}-r\cdot\sin(\omega_1\cdot t)-a\cdot\sin\{\epsilon+(\omega_1+\omega_2)\cdot t\}$$

FIGS. 6, 7, 8, 9, and 10 illustrate the grinding tracks of the abrasive grain during the machining process in the surface machining method according to the present invention. In the drawings, $\omega_1$ is the number of rotations of the wafer 20, $\omega_2$ is the number of revolutions of the wafer 20, $\omega_3$ is the number of rotations of the grinding wheel 18, and R is a distance between the abrasive grain subject to analysis and the center $O_3$ of the grinding wheel 18.

Figure 7:
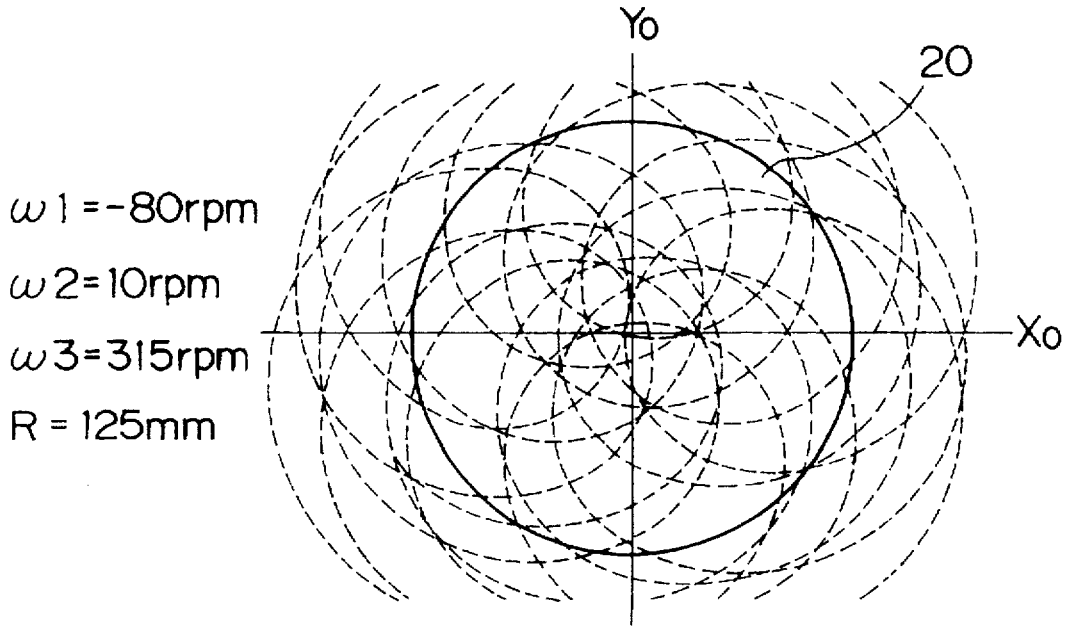
FIG. 7 shows the grinding track of an abrasive grain during machining in a surface machining method according to the present invention.
Figure 8:
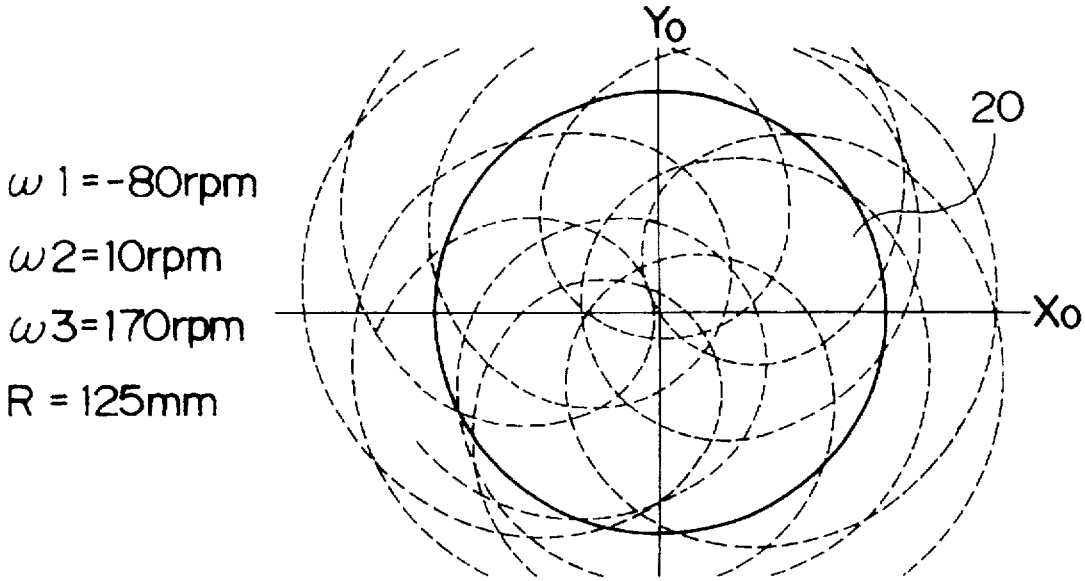
FIG. 8 shows the grinding track of an abrasive grain during machining in a surface machining method according to the present invention.

FIGS. 7 and 8 show the grinding tracks of grind edges of the abrasive grain. The rotation speed $\omega_1$ and the revolution speed $\omega_2$ of the wafer 20 in FIG. 7 are equal to those in FIG. 8 respectively, while the angular velocity $\omega_3$ is only different. As is clear from the drawings, if the angular velocity $\omega_3$ of the grinding wheel 18 increases, the number of streaks in the grinding tracks of the abrasive grain also increase. Moreover, if the angular velocity of rotation or revolution changes, the curvature of the grinding streaks also changes.

For the reasons stated above, if the angular velocity $\omega_3$ of the grinding wheel is raised, and the revolution angular velocity $\omega_2$ of the wafer 20 is changed, the roughness of the machined surface can be reduced.

Figure 9:
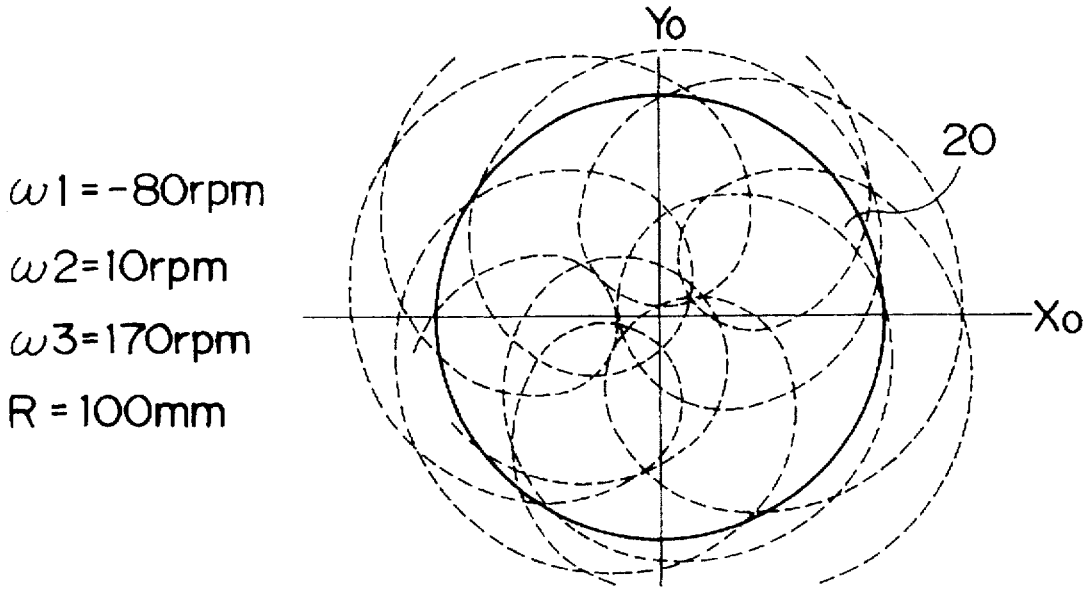
FIG. 9 shows the grinding track of an abrasive grain during machining in a surface machining method according to the present invention.
Figure 10:
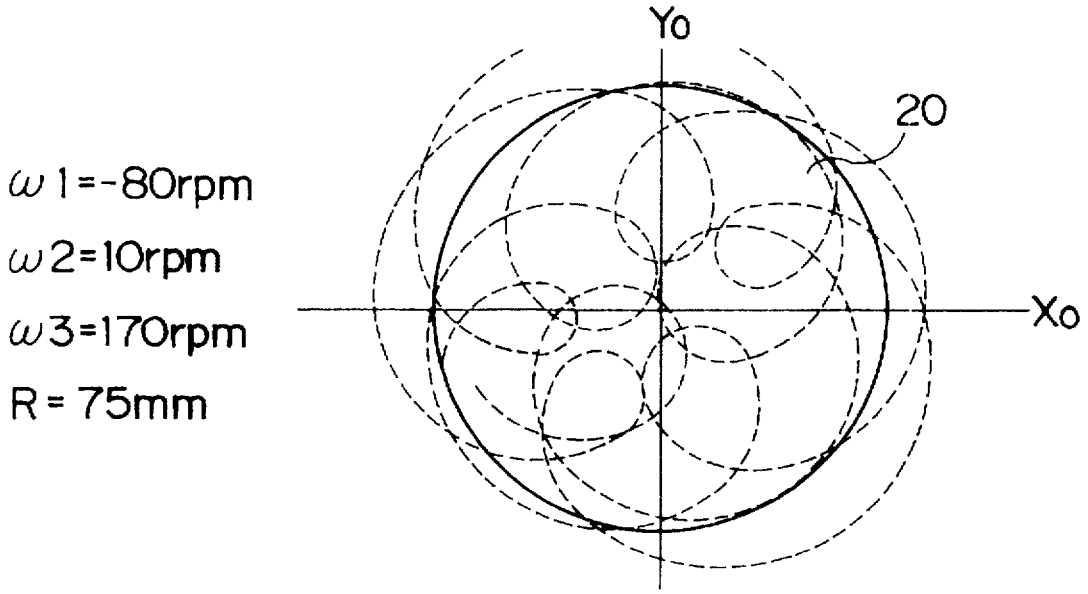
FIG. 10 shows the grinding track of an abrasive grain during machining in a surface machining method according to the present invention.

FIGS. 8, 9 and 10 show the grinding tracks of abrasive grains of different radiuses on the grinding wheel 18. As is clear from the drawings, all abrasive grains on the grinding wheel move on the whole surface of the wafer including the center $O_1$, and the grinding tracks are not concentrated on the center $O_1$.

For the reasons stated above, the abrasive grains can keep the flatness of the machined surface wherever they are located on the grinding wheel. The wafer can be machined in such a state that the grinding wheel is kept flat. Thus, the large area for the grinding wheel is secured, and the grinding resistance per grind edge is decreased. Thereby, the high productivity can be achieved, and the wafer with no warp can be machined.

Figure 11A:
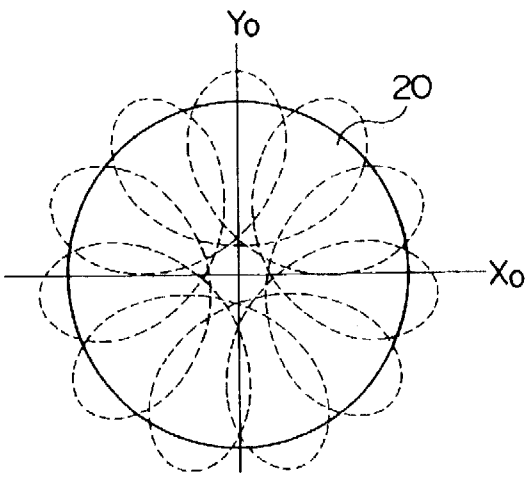
PRIOR ART FIG. 11(A)
FIGS. 11(*a*), 11(*b*), and 11(*c*) show the grinding tracks of abrasive grains during machining in the conventional rotation grinding method.
Figure 11B:
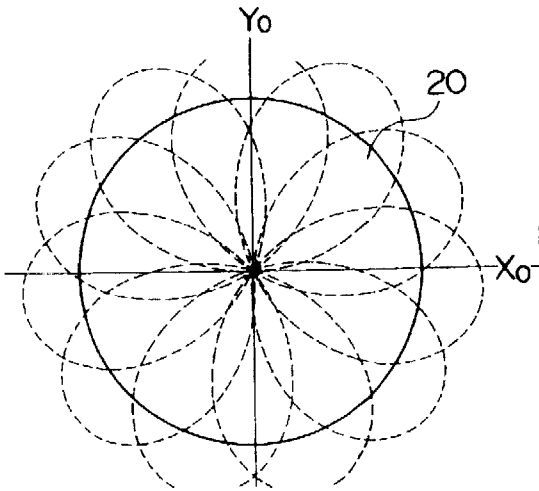
Figure 11C:
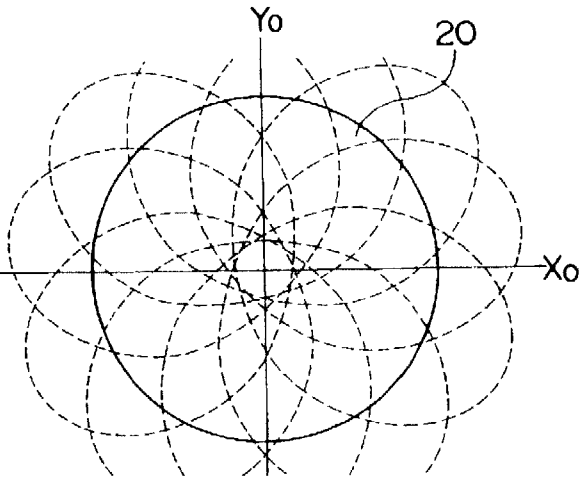

FIGS. 11(*a*), 11(*b*), and 11(*c*) show the grinding tracks in the conventional rotation grinding method (the method in which the wafer 20 does not revolve but rotate). As is clear from the drawings, in the conventional rotation grinding method, the abrasive grains except for those at points of r=a do not go through the center $O_1$ of the wafer 20, and thereby a step is created at the center $O_1$ if the abrasive grains under bad conditions are located at positions of r>a and r<a. Thus, the edge cannot be wide. The tracks of the abrasive grains at r=a are concentrated on the center $O_1$, and the wafer 20 can be warped during machining.

An explanation will hereunder be given about the conditions when all abrasive grains on the grinding wheel 18 move on the wafer 20.

The radius of the wafer 20 is referred to as $R_w$; the radius of revolution of the wafer 20 is referred to as $r_0$; the radius of the outer diameter of the grinding wheel 18 is referred to as $R_H$; the radius of the inner diameter is referred to as $r_H$; and the distance between the revolution center $O_2$ of the wafer 20 and the rotational center $O_3$ of the grinding wheel 18 is referred to as a.

Figure 12:
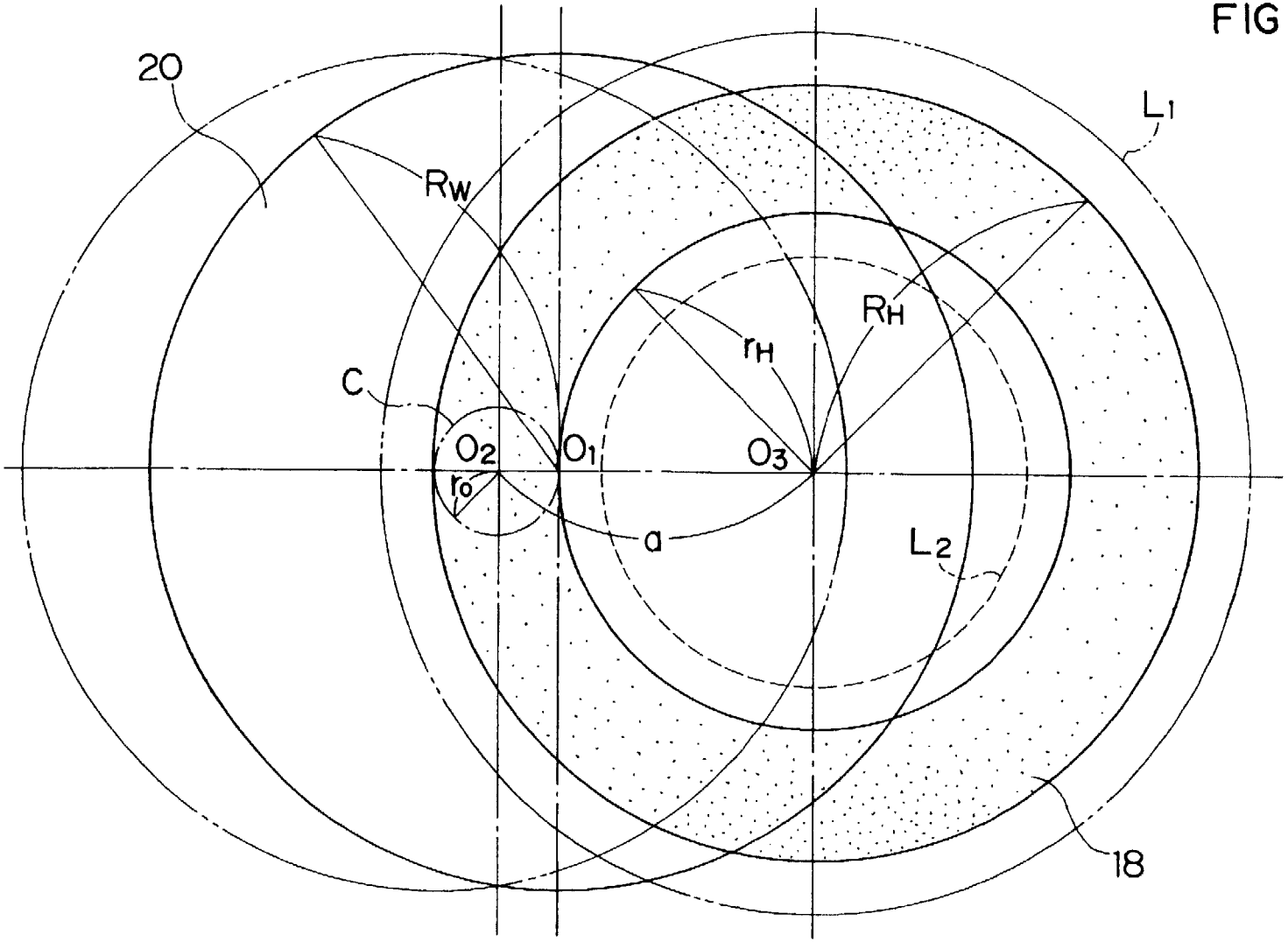
FIG. 12 is an analytic model of grinding wheel conditions.

As indicated in FIG. 12, in the case of $R_H>(a+r_0)$, that is, in the event that the radius $R_H$ is more than the sum $(a+r_0)$ of the distance (a) and the radius $r_0$ of revolution (the state shown with a chain double-dashed line $L_1$, in the drawing), the abrasive grains on the radius $R_H$, of the outer diameter of the grinding wheel 18 do not go through the area in a proximity to the center. For this reason, there is a circle which has not been ground in a proximity to the center. In the case of $r_H<(a-r_0)$, that is, in the event that the radius $r_H$ is less than the difference $(a-r_0)$ between the distance (a) and the radius $r_0$ of revolution (the state shown with a broken line $L_2$ in the drawing), the abrasive grains on the radius $r_H$ of the inner diameter of the grinding wheel 18 do not go through the area in a proximity to the center. For this reason, there is a circle which has not been ground in a proximity to the center as described above.

The following inequalities shows the conditions when all abrasive grains on the grinding wheel 18 move on the wafer 20.

$$(a-r_0)\leq r_H$$

$$R_W-(a+r_0)\leq r_H \qquad (2)$$

As is clear from the above inequalities, the maximum width of the grinding wheel can be twice the radius $r_0$ of revolution. Thus, the distance (a) between the revolution center $O_2$ of the wafer 20 and the rotational center $O_3$ of the grinding wheel 18, and the radius $r_0$ of revolution of the wafer 20 are determined, the width of the usable grinding wheel 18 can be automatically determined. That is, the width of the grinding wheel 18 can be in a range of radius $\pm r_0$ of revolution of the wafer 20 from the revolution center $O_2$ of the wafer 20.

If, for example, the radius $R_w$ of the wafer 20 is 150 mm, the revolution radius $r_0$ of the wafer 20 is 20 mm, and the distance (a) is 100 mm; the wafer can be stably and efficiently ground if the radius $R_H$, of the outer diameter of the grinding wheel 18 is 120 mm and the radius $r_H$ of the inner diameter of the grinding wheel 18 is 80 mm.

As stated above, according to the surface machining method and apparatus of the present invention, the grinding wheel 18 can be wide, and the number of working abrasive grains in the grinding wheel 18 can be large. Thereby, both the grinding efficiency and the throughput are improved. Because the grinding wheel 18 is wide, the load per abrasive grain is decreased, so that the deformation of the wafer can be decreased. This is particularly effective for the machining of thin plates.

All abrasive grains on the grinding wheel 18 move on the surface of the wafer 20, and thereby the flatness of the machined surface and the surface of the grinding wheel can be improved. Thus, the accuracy of the ground surface can be stable.

Moreover, because the number of rotations in one of three rotations (the rotation and revolution of the wafer 20, and the rotation of the grinding wheel 18) is changed, a variety of cutting tracks can be formed. Thereby, the surface of the grinding wheel can be flat, and the dressing and truing of the grinding wheel can be easily performed. Moreover, the curvature of the tracks (grinding streaks) of the abrasive grains on the wafer 20 is reduced, thereby increasing the strength of the wafer 20. This is particularly effective for the machining of thin plates.

Furthermore, the abrasive grains move in a variety of directions, and thereby the machined surface can be flat and the roughness of the surface can be reduced.

In addition, the large area for the grinding wheel can be secured; thus, the method of the present invention may be applied to the grinding under a fixed pressure such as the machining using elastic bond and lapping tape (e.g. a paper grinder), and the machining using the loose abrasive. In this case, in the surface machining apparatus 10 shown in FIG. 1, a lapping plate instead of the grinding wheel 18 is attached to the grinding wheel table 16, and the wafer 20 is rotated and revolved while the loose abrasive is supplied to the space between the lapping plate and the wafer 20. At the same time, the lapping plate is rotated, and it is abutted against the surface of the wafer 20 by a constant force, so that the lapping can be carried out.

In the apparatus shown in FIG. 1, a polishing cloth instead of the grinding wheel 18 may be attached to the grinding wheel table 16, and as stated above, the wafer 20 is rotated and revolved while the loose abrasive are supplied to the space between the polishing cloth and the wafer 20. At the same time, the polishing cloth is rotated, and it is abutted against the surface of the wafer 20 by a constant force, so that the surface machining apparatus of the present invention can perform the polishing or a chemical mechanical polishing (CMP) can be performed.

In this embodiment, the wafer 20 is rotated and revolved; however, if the grinding wheel 18 is rotated and revolved in the apparatus shown in FIG. 1, the same effect can be achieved. That is, the wafer 20 is rotated on its axis $O_1$, and the grinding wheel 18 is rotated on its own axis $O_3$. The grinding wheel 18 is also revolved around the rotational center which is biased with regard to the rotational axis $O_3$ of the grinding wheel 18 and the rotational axis $O_1$ of the wafer 20. This is the same as in the case when the lapping plate or the polishing cloth instead of the grinding wheel 18 is rotated and revolved in the above-mentioned lapping apparatus, polishing apparatus, and CMP apparatus.

As set forth hereinabove, all abrasive grains on the surface of the grinding wheel move on the surface of the workpiece. Thereby, the width of the grinding wheel can be large, and the number of working abrasive grains can be increased. Thus, the grinding efficiency and the throughput can be improved. In addition, because the width of the grinding wheel can be large, the grinding load per abrasive grain can be reduced, and the depth of the warp of the workpiece can be decreased.

Moreover, according to the present invention, all abrasive grains on the surface of the grinding wheel move on the surface of the workpiece, thereby improving the flatness of the machined surface and the surface of the grinding wheel.

Furthermore, the number of rotations of one of the above-mentioned three rotations is changed so that a variety of grinding tracks can be formed. Thereby, the surface can be flat, and the dressing and truing of the grinding wheel can be easily performed. The accuracy of the ground surface can be stable as a result. Furthermore, the curvature of the tracks (grinding tracks) of the abrasive grains on the surface of the workpiece can be reduced, thereby increasing the strength of the workpiece.

In addition, the area for the grinding wheel can be large, so that the method of the present invention can be applied to the grinding under a fixed pressure such as the machining using elastic bond and lapping tape (e.g. paper grinding wheel), and the machining using the loose abrasive.

It should be understood, however, that there is no intention to limit the invention to the specific forms disclosed, but on the contrary, the invention is to cover all modifications, alternate constructions and equivalents falling within the spirit and scope of the invention as expressed in the appended claims.

I claim:

1. A surface machining method for machining a surface of a workpiece with a rotating cup-shaped grinding wheel, comprising the steps of:

rotating said workpiece on a rotational center which is offset from a rotational center of said grinding wheel, and revolving said workpiece around a revolution center which is offset from the rotational center of said workpiece and the rotational center of said grinding wheel; and machining the surface of said workpiece by pressing the workpiece against a rotating cup-shaped grinding wheel;

wherein said workpiece is rotated by a rotating drive; wherein the workpiece is revolved by a revolving drive; wherein said grinding wheel is rotated a rotary drive; wherein the rotational speed of the rotating drive, the rate of revolution of the revolving drive and the rotational speed of the rotary drive, are all set independent of each other; and wherein said machining step is performed in accordance with the relationships:

$$(a-r_0)\leqq r_H \text{ and } R_w-(a+r_0)\leqq r_H$$

where a is a distance between the revolution center of the workpiece and the rotational center of the grinding wheel, $r_0$ is a radius of revolution of the workpiece, $r_H$ is a radius of an inner diameter of the grinding wheel and $R_w$ is a radius of the workpiece.

2. A surface machining apparatus comprising:

a grinding wheel table for supporting and rotating a cup-shaped grinding wheel;

a workpiece table for supporting a workpiece and rotating said workpiece on a rotational center which is offset from a rotational center of said grinding wheel table;

a rotary table for revolving said workpiece table around a revolution center which is offset from the rotational center of said grinding wheel table and the rotational center of said workpiece table, said rotary table being connecting to said workpiece table at the rotational center of said workpiece table; and wherein a rotating drive is provided for rotating said workpiece table; wherein a revolving drive is provided for revolving the rotary table; wherein a rotary drive is provided for rotating said grinding wheel table; wherein the rotational speed of the rotating drive, the rate of revolution of the revolving drive and the rotational speed of the rotary drive, are all settable independent of each other; wherein, while said workpiece is rotated by said workpiece table and revolved by said rotary table, said workpiece is pressable against said rotating grinding wheel so that a surface of said workpiece is machined by said grinding wheel; and wherein the relationships:

$$(a-r_0)\leqq r_H \text{ and } R_w-(a+r_0)\leqq r_H$$

are maintained between a distance a between the revolution center of the workpiece and the rotational center of the grinding wheel, a radius of revolution of the workpiece $r_0$, a radius of an inner diameter of the grinding wheel $r_H$ and a radius of the workpiece $R_w$.

3. The surface machining apparatus as defined in claim 2, wherein a width of said grinding wheel is in a range of a revolution radius $\pm r_0$ of said workpiece from the rotational center of said rotary table.

4. A surface machining method for machining a surface of a workpiece with a rotating toroidal lapping plate, comprising the steps of:

rotating said workpiece on a rotational center which is offset from a rotational center of said lapping plate, and revolving said workpiece around a revolution center which is offset from the rotational center of said workpiece and the rotational center of said lapping plate and machining the surface of said workpiece and machining the surface of said workpiece by pressing the workpiece against the rotating toroidal lapping plate while loose abrasive is supplied to a space between said lapping plate and said workpiece;

wherein said workpiece is rotated a rotating drive; wherein the work piece is revolved by a revolving drive; wherein said lapping plate is rotated a rotary drive; wherein the rotational speed of the rotating drive, rate of revolution of the revolving drive and the rotational speed of the rotary drive, are all set independent of each other; and wherein said machining is performed in accordance with the relationships:

$$(a-r_0)\leqq r_H \text{ and } R_w-(a+r_0)\leqq r_H$$

where a is a distance between the revolution center of the workpiece and the rotational center of the grinding wheel, $r_0$ is a radius of revolution of the workpiece, $r_H$ is a radius of an inner diameter of the grinding wheel and $R_w$ is a radius of the workpiece.

5. A surface machining apparatus comprising:

a lapping plate table for supporting and rotating a toroidal lapping plate;

a workpiece table for supporting a workpiece and rotating said workpiece on a rotational center which is offset from a rotational center of said lapping plate table;

a rotary table for revolving said workpiece table around a revolution center which is offset from the rotational center of said lapping plate table and the rotational center of said workpiece table, said rotary table being connected to said workpiece table at the rotational center of said workpiece table; and wherein a rotating drive is provided for rotating said workpiece table; wherein a revolving drive is provided for revolving the rotary table; wherein a rotary drive is provided for rotating said lapping plate table; wherein the rotational speed of the rotating drive, the rate of revolution of the revolving drive and the rotational speed of the rotary drive, are all settable independent of each other; wherein, while said workpiece is rotated by said workpiece table and revolved by said rotary table, said workpiece is pressable against said rotating lapping plate and loose abrasive is supplied to a space between said lapping plate and said workpiece, so that a surface of said workpiece is machined by said lapping plate; and wherein the relationships:

$$(a-r_0)\leqq r_H \text{ and } R_w-(a+r_0)\leqq r_H$$

are maintained between a distance a between the revolution center of the workpiece and the rotational center of the grinding wheel, a radius of revolution of the workpiece $r_0$, a radius of an inner diameter of the grinding wheel $r_H$ and a radius of the workpiece $R_w$.

6. The surface machining apparatus as defined in claim 5, wherein a width of said lapping plate is in a range of a revolution radius $\pm r_0$ of said workpiece from the rotational center of said rotary table.

7. A surface machining method for machining a surface of said workpiece with a rotating toroidal polishing cloth, comprising the steps of:

rotating said workpiece on a rotational center which is offset from a rotational center of said polishing cloth, and revolving said workpiece around a revolution center which is offset from the rotational center of said workpiece and the rotational center of said polishing cloth and machining the surface of said workpiece by pressing the workpiece against the rotating toroidal polishing cloth while loose abrasive is supplied to a space between said polishing cloth and said workpiece; wherein said workpiece is rotated a rotating drive; wherein the work piece is revolved by a revolving drive; wherein said lapping plate is rotated a rotary drive; wherein the rotational speed of the rotating drive, rate of revolution of the revolving drive and the rotational speed of the rotary drive, are all set independent of each other; and wherein said machining is performed in accordance with the relationships:

$$(a-r_0)\leqq r_H \text{ and } R_w-(a+r_0)\leqq r_H$$

where a is a distance between the revolution center of the workpiece and the rotational center of the grinding wheel, $r_0$ is a radius of revolution of the workpiece, $r_H$ is a radius of an inner diameter of the grinding wheel and $R_w$ is a radius of the workpiece.

8. A surface machining apparatus comprising:

a polishing cloth table for supporting and rotating a toroidal polishing cloth;

a workpiece table for supporting a workpiece and rotating said workpiece on a rotational center which is offset from a rotational center of said polishing cloth table;

a rotary table for revolving said workpiece table around a revolution center which is offset from the rotational center of said polishing cloth table and the rotational center of said workpiece table, said rotary table connecting to said workpiece table at the rotational center of said workpiece table; and wherein a rotating drive is provided for rotating said workpiece table; wherein a revolving drive is provided for revolving the rotary table; wherein a rotary drive is provided for rotating said polishing cloth table; wherein the rotational speed of the rotating drive, the rate of revolution of the revolving drive and the rotational speed of the rotary drive, are all settable independent of each other; wherein, while said workpiece is rotated by said workpiece table and revolved by said rotary table, said workpiece is pressed against said rotating polishing cloth and loose abrasive is supplied to a space between said polishing cloth and said workpiece, so that a surface of said workpiece is machined by said polishing cloth; and wherein the relationships:

$$(a-r_0)\leqq r_H \text{ and } R_w-(a+r_0)\leqq r_H$$

are maintained between a distance a between the revolution center of the workpiece and the rotational center of the grinding wheel, a radius of revolution of the workpiece $r_0$, a radius of an inner diameter of the grinding wheel $r_H$ and a radius of the workpiece $R_w$.

9. The surface machining apparatus as defined in claim 8, wherein a width of said polishing cloth is in a range of a revolution radius $\pm r_0$ of said workpiece from the rotational center of said rotary table.

* * * * *